US006089940A

United States Patent [19]

Farrar

[11] Patent Number: 6,089,940

[45] **Date of Patent: *Jul. 18, 2000**

[54] MODEL AIRPLANE KIT

[76] Inventor: Rodney K. Farrar, 11127 W. Dorado Pl., Littleton, Colo. 80127-1069

[ * ] Notice: This patent is subject to a terminal disclaimer.

[21] Appl. No.: 08/942,378

[22] Filed: Oct. 1, 1997

Related U.S. Application Data

[63] Continuation-in-part of application No. 08/489,805, Jun. 12, 1995, Pat. No. 5,676,580.

[51] Int. Cl.[7] ..... A63H 27/00

[52] U.S. Cl. ..... 446/88; 446/34

[58] Field of Search ..... 446/88, 86, 87, 446/34, 71

[56] References Cited

U.S. PATENT DOCUMENTS

| | | | |
|---|---|---|---|
| 2,347,561 | 4/1944 | Howard Et Al. | 434/372 |
| 2,676,431 | 4/1954 | Goldberg | 446/88 |
| 2,939,242 | 6/1960 | Papadakis | 264/294 |
| 3,017,487 | 1/1962 | Priestly | 219/29 |
| 3,297,856 | 1/1967 | Gershon | 219/233 |
| 3,590,517 | 7/1971 | Regehr | 46/76 |
| 3,895,438 | 7/1975 | Burkepile et al. | 30/116 |
| 3,963,554 | 6/1976 | Sigafoose | 156/304.2 |
| 4,103,454 | 8/1978 | Stone | 446/67 |
| 4,266,366 | 5/1981 | Lapierre | 446/86 |
| 4,270,301 | 6/1981 | Meek | 446/88 |
| 4,379,010 | 4/1983 | Renger | 156/108 |
| 4,388,777 | 6/1983 | Hermann et al. | 46/79 |
| 4,895,541 | 1/1990 | Miller | 446/57 |
| 5,334,068 | 8/1994 | Davis | 446/34 |
| 5,676,580 | 10/1997 | Farrar | 446/34 |

FOREIGN PATENT DOCUMENTS

| | | | |
|---|---|---|---|
| 3039-403 | 10/1980 | Germany | 446/34 |

*Primary Examiner*—Robert A. Hafer
*Assistant Examiner*—Michael B. Priddy
*Attorney, Agent, or Firm*—Daniel N. Lundeen

[57] ABSTRACT

A model airplane, airplane kit, and method of making a model airplane. The kit of the present invention enables children and adults to easily make a well-flying model airplane using recycled plastic foam moldings such as polystyrene food trays well known as 10-S in the food packaging arts.

12 Claims, 4 Drawing Sheets

FIG.1
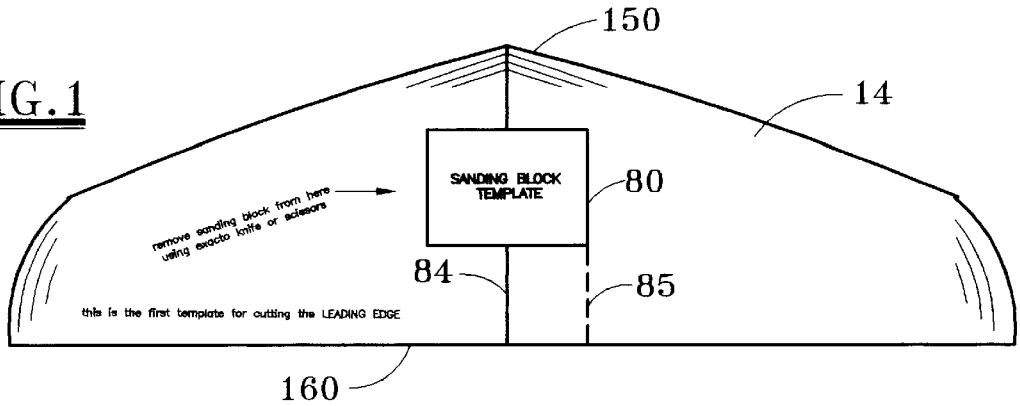
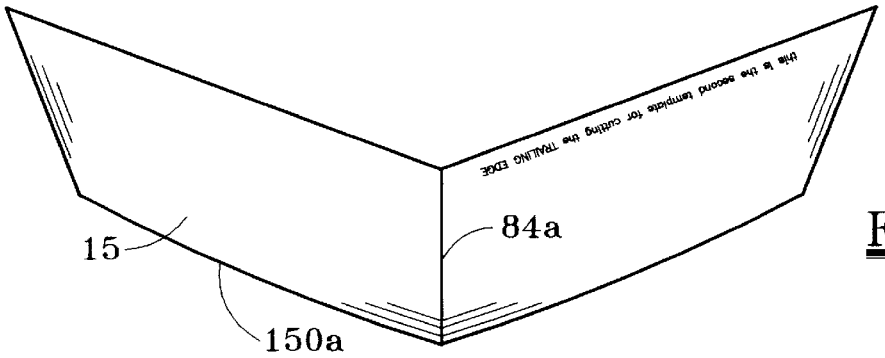
FIG.2
FIG.3
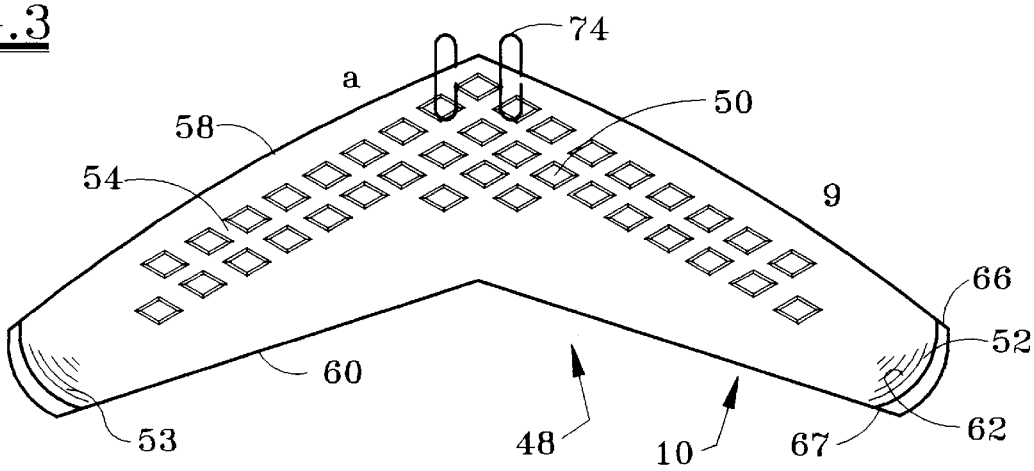
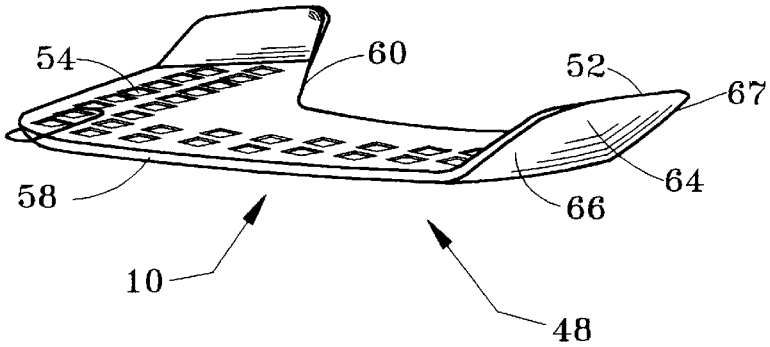
FIG.4

MODEL AIRPLANE KIT

CROSS-REFERENCE TO RELATED APPLICATION

This is a continuation-in-part of my earlier U.S. Ser. No. 08/489,805, flied Jun. 12, 1995, now U.S. Pat. No. 5,676,580.

FIELD OF THE INVENTION

The present invention relates to a model airplane and a kit and method for making the same. More particularly, the present invention relates to a model airplane constructed from a polystyrene foam food tray and a kit and method for making the airplane.

BACKGROUND OF THE INVENTION

Toy airplanes which fly through the air when thrown by hand are well known in the art. Among such toy airplanes designed to fly are model gliders constructed from balsa wood. U.S. Patents describing flying toy airplanes include U.S. Pat. No. 3,590,517 to Regehr; U.S. Pat. No. 4,895,541 to Miller; U.S. Pat. No. 4,103,454 to Stone; and U.S. Pat. No. 4,388,777 to Herman.

Plastic foam cutters employing a heated wire are also well known in the art. Such cutters are described in U.S. Pat. No. 3,895,438 to Burkepile et al.; U.S. Pat. No. 3,297,856 to Gershon; and U.S. Pat. No. 3,017,487 to Priestly. Another foam cutter is described and claimed in my earlier U.S. Pat. No. 5,676,580 mentioned above which is hereby incorporated by reference herein in its entirety.

Applicant is unaware of the prior use of polystyrene foam trays as a primary material for making a model airplane, nor of any kit or methodology for the construction thereof.

SUMMARY OF THE INVENTION

The model airplane kit of the present invention includes components to build a well flying model airplane from food trays commonly used to display meat or produce or other food items in a grocery store and generally discarded afterwards.

As one embodiment, the present invention provides a method for making a model airplane. As a first step, an airplane wing template is removably secured to a preformed plastic foam molding. As a second step, the wing is cut from the foam molding cutting along an edge of the template. Preferably, a first template is used to cut a leading edge of the wing and a second template is used to cut a trailing edge of the wing. An airfoil is then sanded on the wing. Weights are attached to a nose of the wing. Optionally wheels are cut from the foam molding, attached to a wire and secured to the wings to form landing gear. The wing cutting step preferably includes the step of latching a cutting wire to a U-bend hook to complete an electrical circuit with a battery and heat the wire. The plastic foam molding preferably comprises a polystyrene 10-S food or meat tray commonly found in the grocery store. The wheels are preferably cut from the foam using a tubular die.

As another embodiment, the present invention provides a model airplane kit. The kit comprises a preformed plastic foam molding, an optional plastic foam cutter, a template for cutting a wing from the plastic foam molding, sandpaper for sanding an airfoil on the wing, one or more weights for weighting a nose of the wing, an optional die for cutting wheels from the foam sheet, and an optional wire for attaching the wheels to the wing and forming a landing gear for the model airplane. The kit preferably comprises a polystyrene foam molding in the form of a 10-S food or meat tray commonly found in the grocery store. The kit preferably includes a template for making a sanding block from residual foam sheet.

As yet a further embodiment, the present invention provides a model airplane made by the steps of: securing a wing template against a preformed plastic foam molding; cutting the wing from the foam molding; sanding an airfoil on the wing; attaching weights to a nose of the wing; and optionally making a landing gear for attachment to an underside of the wing by cutting wheels from the foam molding, attaching the wheels to a wire and securing the wire to the wings. The plastic foam molding preferably comprises a polystyrene 10-S food or meat tray commonly found in the grocery store. The wheels are preferably cut from the foam molding using a tubular die.

In another aspect, the invention provides a model airplane having a wing and symmetrical upturned winglets formed at either end of the wing. The wing has a swept back leading edge and an airfoil with a generally convex upper surface. The wing is symmetrical with respect to a centerline extending rearwardly from the nose at an apex of the leading edge. The winglets each have an upper reflex area having concavity in a horizontal plane and in a vertical plane at a right angle to the wing centerline. A leading portion of each winglet extends rearwardly from the leading edge of the wing with upper, inner and lower, outer surfaces parallel to the wing centerline. The upper, inner surfaces have concavity in said vertical plane. A trailing winglet portion curves inwardly and rearwardly from the leading winglet portion toward said centerline to define said reflex area. The wing preferably has a flat lower surface between the winglets and is sculpted from a 10-S polystyrene foam tray.

BRIEF DESCRIPTION OF THE DRAWINGS

FIG. 1 is a plan view of a first template for cutting the leading edge of the wing according to the present invention.

FIG. 2 is plan view of a second template for cutting the trailing edge of the wing according to the present invention.

FIG. 3 is a plan view of a wing according to the present invention.

FIG. 4 is a side-frontal perspective view of the wing of FIG. 3.

DETAILED DESCRIPTION OF THE INVENTION

Figure 5:
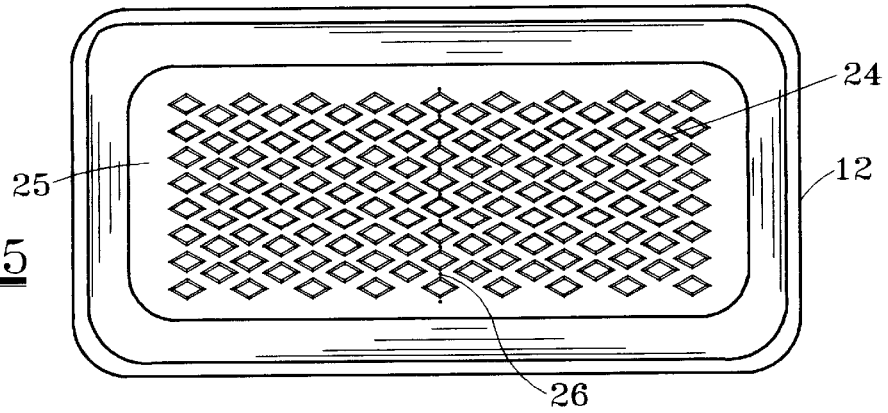
FIG. 5 is a top plan view of a polystyrene foam molding showing the location of pin holes for the location of the reference line in the fabrication of the wing according to the present invention.

Recycled materials including old film canisters and disposable Styrofoam meat trays are used to build a well flying model airplane for the amusement of both children and adults.

Referring to FIGS. 1–18, a model airplane 10 which can supply long lasting enjoyment for children and adults is cut from a preformed molding of plastic foam 12 using a foam cutter (not shown) and first and second wing templates 14,15 for tracing the wing pattern on the foam molding 12. In the practice of the present invention, the plastic foam molding 12 preferably comprises a size 10-S meat or food tray made of polystyrene foam.

The preferred foam cutter is described in and illustrated in my earlier U.S Pat. No. 5,676,580. This is an optional feature of the present kit which can include the preferred foam cutter, a different type of hot wire foam cutter, a knife or other tool for cutting polystyrene foam sheet, or the cutting tool can be supplied by the user.

The model airplane 10 of the present invention has a wing 48 which includes a swept back leading edge 58, a complementary trailing edge 60 and raised tips or winglets 52 at either end thereof. The wing 48 is made by securing the templates 14,15 in turn to the flat surface of the polystyrene tray 12, e.g. by using double-sided adhesive tape between the templates 14,15 and the tray 12, and then cutting a leading edge 50 and trailing edge 60 using the respective template 14 or 15.

Figure 6:
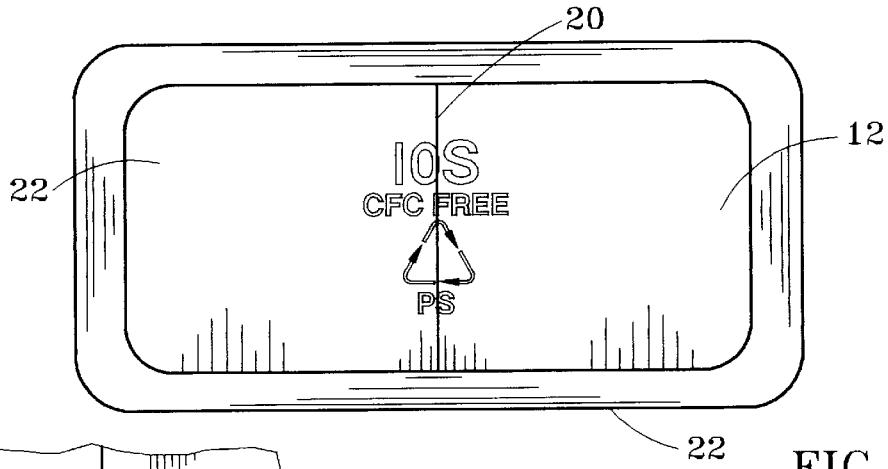
FIG. 6 is a plan view of the bottom of the polystyrene foam molding of FIG. 5 showing the location of the reference line.

As best seen in FIGS. 5 and 6, a reference line 20 is drawn transversely across the exact center of the back side 22 of the foam molding 12. To mark the molding 12, advantage can be taken of the symmetrical waffle pattern formed by diamonds 24 typically imprinted on the upper surface 25 of the foam molding 12 (see FIG. 5). A pin (not shown) is used to poke holes 26 straight through the foam molding 12 at the center of the "X" between the central row of diamonds 24, typically the ninth row from either longitudinal end of the upper surface 25. These holes 26 then lie in a straight line visible on the back side 22 of the foam molding 12 which can be used to position the reference line 20 using a suitable straight edge and pen or pencil (not shown).

The templates 14,15 can be a paper or cardboard form, desirably cut from a pre-printed sheet (not shown). The sheet can also include a sanding block template 80, preferably printed in the template 14 along a centerline locating aid 84 printed along a centerline of template 14. If desired, a dotted line 85 an also be printed from a trailing edge 160 of the first template 14 to mark a place to cut into the first template 14 to cut out the sanding block template 80. This line 85 can be repaired by closing the incision with tape (not shown) to restore the integrity of the first template 14.

Figure 7:
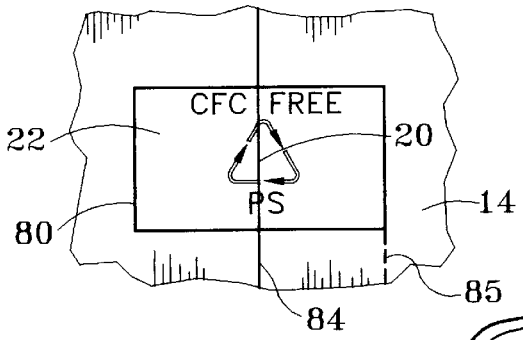
FIG. 7 is a close up plan view of the first template placed over the underside of the polystyrene foam molding showing the alignment of the reference line and the centerline locating aid according to the present invention.
Figure 8:
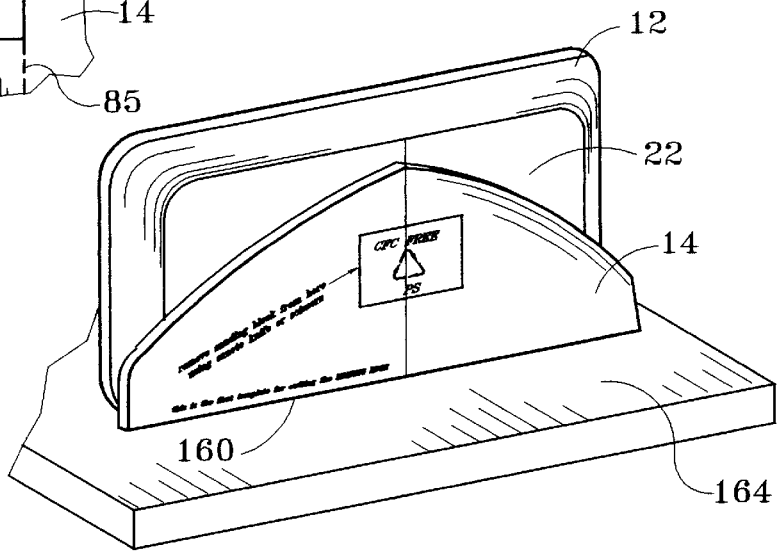
FIG. 8 is a perspective view of the first template positioned on the underside of the polystyrene foam molding for the fabrication of the wing according to the present invention.

As best seen in FIG. 7, the removal of the sanding block template 80 from the first template 14 allows the reference line 20 to be seen when the first template 14 is positioned on the back side 22 of the molding 12 and facilitate alignment of the reference line 20 with the preprinted centerline locating aid 84 which is critical to the ultimate aerodynamics of the wing 48. The trailing edge 160 of the first template 14 and a bottom 22 of the foam molding 12 are positioned to rest on a flat surface 164 such as a tabletop with the first template 14 held against the back side of the foam molding 12 with the reference line 20 and centerline locating aid 84 in alignment. When the first template 14 and foam molding 12 can be aligned properly with the back side 22 of the foam molding 12 and first template 14 completely vertical at a right angle to the top of the flat surface 164, the first template 14 can be removably secured in relative position to back side 22 of the foam molding 12 using two or three pieces of two-sided tape between them.

Figure 9:
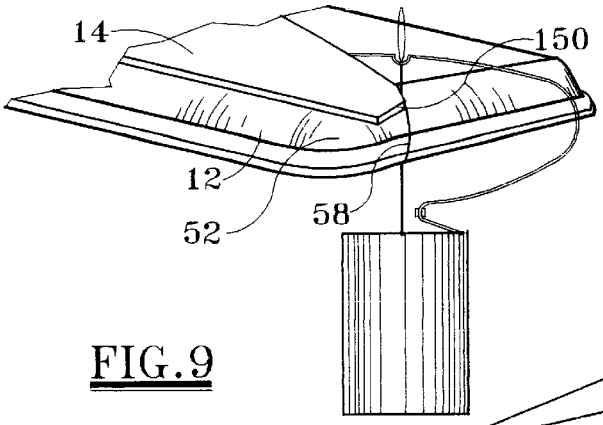
FIG. 9 is a side perspective view showing the cutting of the polystyrene foam molding with a hot wire cutter using the first template according to the principles of the present invention.

The leading edge 58 of the wing 48 is then cut by tracing the cutting tool, preferably a hot wire cutter, as perpendicularly as possible along the leading edge 150 of the first template 14. Using a hot wire cutter, the cutter should be slid smoothly and evenly throughout the polystyrene foam molding 12 to trace out the leading edge 58, without forcing or stopping the wire cutter to avoid tearing or melting an unwanted hole or tear in the wing 48. Some practice may be helpful to keep the cutter perpendicular to the first template 14, especially in areas of the winglet 52 where the foam molding 12 and first template 14 makes a sharp curve. I have found that it is helpful to hold the foam molding 12 at eye level while cutting and using one eye to line things up as seen in FIG. 9, keeping the other eye closed. It also helps to make two cuts, beginning each at a respective winglet 52 and cutting in toward the centerline 20. Also, depending on the depth of the throat of the hot wire cutter, it may be necessary to trim off excess foam from the molding 12 to accommodate the hot wire cutter.

Figure 10:
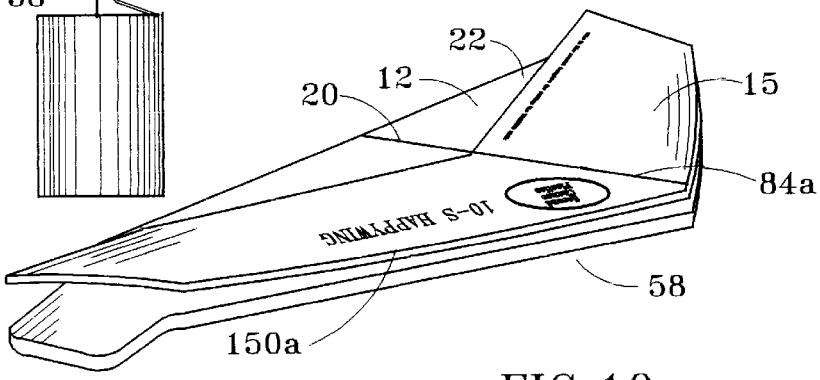
FIG. 10 is a side-front perspective view of a second template positioned on the polystyrene foam molding after the cutting of the leading edge in preparation for the cutting of the trailing edge according to the principles of the present invention.
Figure 15:
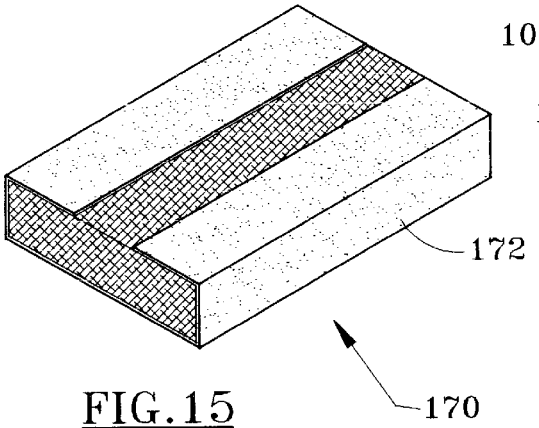
FIG. 15 is a perspective view of a sanding block according to the principles of the present invention.

The trailing edge 60 is then cut in the foam molding 12 using the second template 15 and cutting tool in much the same manner as the first template 14. As best seen in FIG. 10, the first template 14 is removed and second template 15 is removably secured to back side 22 of foam molding 12 using the two-three pieces of two-sided tape, aligning the leading edge 58 of the foam molding 12 with a leading edge 150*a* of the second template 15 and the reference line 20 with a preprinted centerline locating aid 84*a*.

The winglets 52 of the wing 48 are formed by the upturned edges of the foam molding 12. As best seen in FIGS. 3–4 and 11–14, the span portion 50 defines respective top and bottom planar surfaces 54, 56 and the respective leading and trailing edges 58, 60. The winglets 52 define planar side surfaces 62, 64 and leading and trailing edges 66, 67.

An aerodynamically stable cross-section (see FIG. 11) is formed in the winglets 52 by sanding the planar side surfaces 62, 64 at the leading edge 66 thereof. A sanding block 170 (see FIG. 15) can be conveniently made from a residual section of the foam molding 12 by cutting a block shape therefrom using the sanding block template 80, for example. The sanding block 170 is covered with sandpaper 172 which is taped in place around the block 170.

Figure 13:
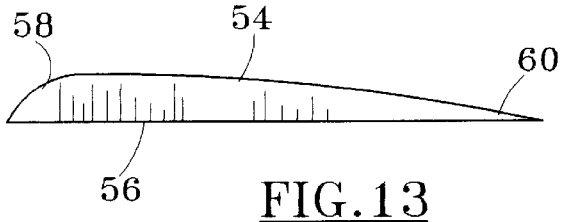
FIG. 13 is a vertical cross-sectional view of the wing span of the model airplane of FIG. 11 showing the particular shape of the airfoil at the wing leading and trailing edges.
Figure 14:
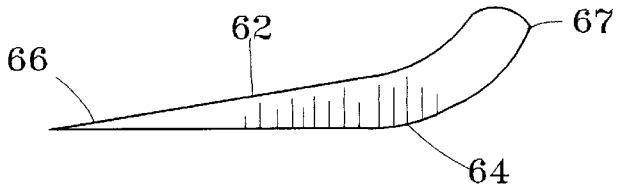
FIG. 14 is a horizontal cross-section view of the wing tip of the model airplane of FIG. 11.

As seen in FIG. 13, the span 50 has an airfoil shape. The airfoil is preferably produced by lightly sanding the span top surface 54 at the leading and trailing edges 58, 60 in an acceptable fashion. The span bottom surface 56 is generally not altered. I found it works well to shape the leading edge 58 on the edge of a table top or other flat surface which can be protected from marring by the sandpaper with several thickness of newspaper or other protective coating. The sanding block 170 is desirably moved from side to side to create a gently curved surface which slopes downwardly to the point where the leading edge 58 meets the lower surface 56 of the wing 48. Generally, the diamonds 24 in the pattern in the first row and part of the second row will be sanded smooth. Special attention should be given to the area where the leading edge 58 meets the winglet 52. Desirably, the sanding will create a shape here which will direct the air flow smoothly over the top surface 54 of the wing 48 and into the reflex area 53 of the winglet 52. The reflex area 53 comprises the frontally exposed portion of the surface 62 which extends over the front profile of the leading edge 66, preferably inwardly concave, outwardly convex, resulting as an artifact from sculpting the winglets 52 from the upward shape of the edge of the original 10-S polystyrene foam tray. I prefer to sand foam out of this transition area using an edge of the sanding block 170 to make a thin-edged miniature air scoop. When the sanding is finished, the sharp leading edge 58 of the wing 48 should form a continuous line with the leading edge 66 of the winglet 52 with a sharp corner formed at the transition between the wing 48 and winglet 52.

The trailing edge 60 is then formed by sanding the top surface 54 in a manner similar to that for forming the leading edge 58. As best seen in FIG. 13, there is a slope from approximately the middle of the upper surface 54 of the wing 48 back to the trailing edge 60. Conveniently, the wing is held down on the work surface and sanded over the surface 54 using sanding strokes which are down-and-away or side-to-side. The trailing edge 60 is preferably about 1 mm thick and should slope smoothly up into the reflex area 53 near either winglet 52. Making the trailing edge 60 paper thin does not seem to improve the flight of the wing 48, and in some cases seems to actually degrade the sink rate. It also helps to have some stiffness in the trailing edge 60 where one's thumb pushes on the wing 48 during launching.

Desirably, the winglets 52 should be as lightweight and thin as possible to reduce drag. The leading edge 66 should be paper thin, and lower edges of the winglets 52 should be parallel to the reference line 20. This shape is formed by sanding the winglets 52 using the sanding block 170. The surface 64 can be conveniently sanded by holding the wing blank in one hand with the upper surface 25 facing downward, and sanding the surfaces 64 with repeated downward strokes. Some strokes can be angled toward the front or back of the wing 48, but they should all move generally from the lower wing surface 56 toward a tip of the winglet 52. I prefer to periodically check visually to see how thin the winglet 52 is getting. When the shaping is completed, there should still be some unsanded curved portion of the lower surface 56 at the trailing edges 67 of the winglet 52.

Following the aerodynamic shaping of the wing 48, the airplane is completed by weighting the nose 51 and attaching a landing gear 72. The nose 51 can be conveniently weighted by a pair of number one paper clips 74 on either side thereof which are then adjusted fore and aft for best flight characteristics. In addition, the wing 48 can be further sanded to fine tune the glide characteristics. For example, if the wing 48 turns right, sanding off a slight portion of the reflex surface adjacent the right winglet 52 can correct the turning tendency.

Figure 16:
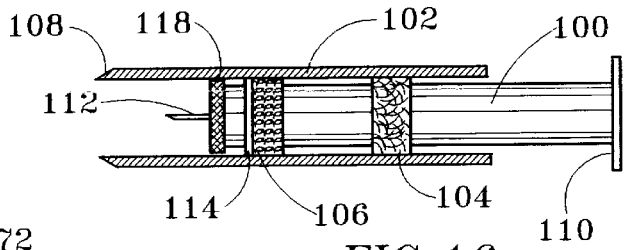
FIG. 16 is a sectional view of a wheel-cutting die according to the principles of the present invention.

The landing gear 75 can be made of polystyrene foam wheels 76 of an appropriate size attached to the bottom surface 56 of the wing 48 by steel wires 78 bent to an accommodating shape. The wires 78 can be attached to the wing 48 by adhesive tape. The wheels 76 are conveniently cut from an unused residual portion of the polystyrene sheet 12 preferably using a die comprising a piece of thin walled ½ inch tubing. In a preferred embodiment, the die comprises concentric tubes, including a smaller tube 100 and a larger tube 102 as seen in FIGS. 16 ad 17. The smaller tube 100 is slideably received in the larger tube 102, preferably using spacer elements 104 and 106 secured to an outer surface of the smaller tube 100 along a diameter thereof.

Figure 17:
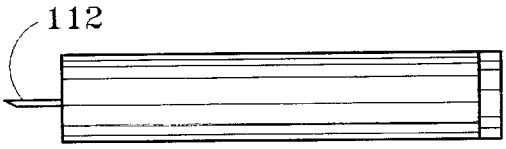
FIG. 17 is perspective side view of the wheel-cutting die of FIG. 16 with the pin-plunger shown in the advanced position.
Figure 18:
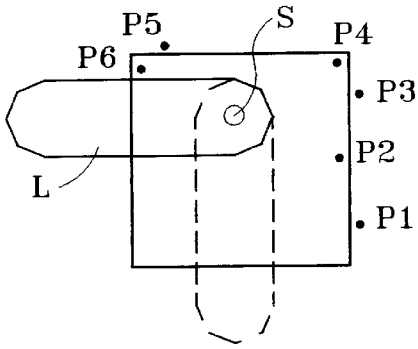
FIG. 18 is a plan view of a jig for bending a wheel strut according to the principles of the present invention.
Figure 11:
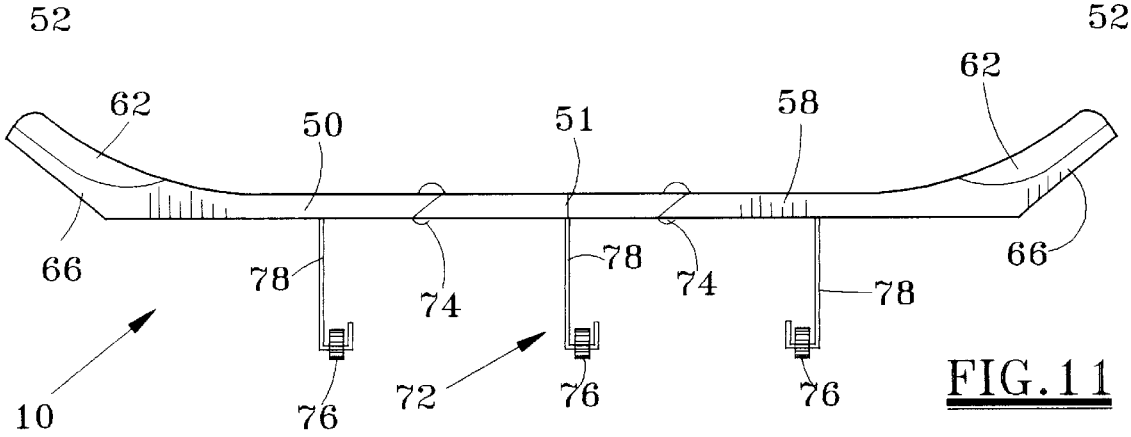
FIG. 11 is a frontal view of a model airplane constructed according to the principles of the present invention showing the raised tips of the wing.
Figure 12:
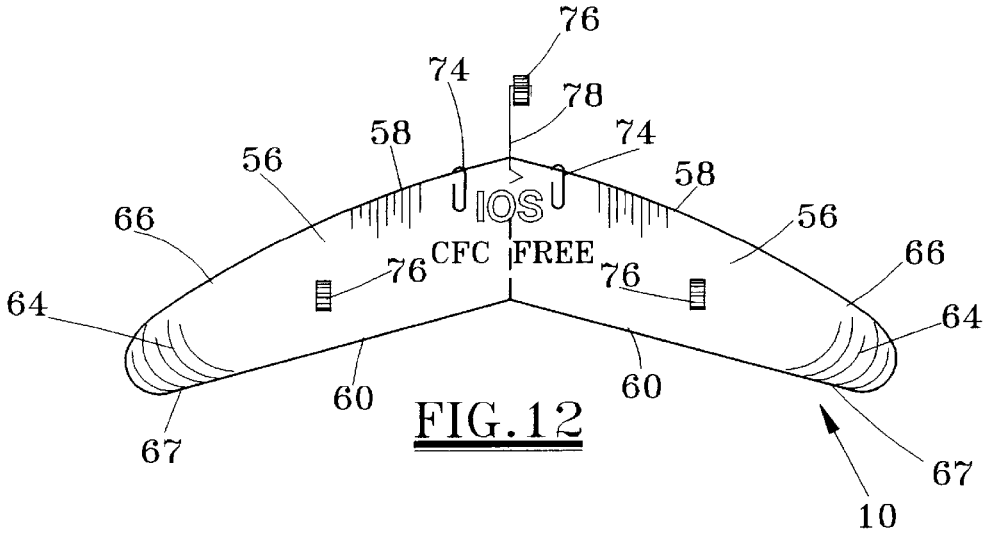
FIG. 12 is a bottom view of the model airplane of FIG. 11.

Conveniently, the spacer element 104 can be a piece of adhesive loop material, and the spacer element 106 an adhesive-backed hook material, as in a VELCRO® fastener. The large tube 102 preferably has a distal end which is sharpened for cutting the wheel shape from the polystyrene foam. A proximal end of the small tube 100 has a rubber stop secured thereto which has an outside diameter at least as large as an inside diameter of the large tube 102. The distal end of the small tube 100 has a concentric pin protruding axially outwardly from an anchor 114 secured in the tube 100, for example, with glue or welding. The pin 112 passes through a disk of polystyrene foam 118 secured, for example, with glue, to the distal end of the small tube 100. The disk 118 has an outside diameter matching an inside diameter of the large tube 102. When the small tube 100 is inserted completely into the large tube 102 so that the distal end of the large tube 102 abuts the stop 110, as shown in FIG. 17, the distal end of the disk 118 is flush with the distal end 108 of the large tube 102 and a portion of the pin 112 extends therefrom.

In using the die, a clear area on a piece of scrap polystyrene foam is found. The small tube 100 is retracted from the large tube 102 so that the pin plunger will not stick into the polystyrene foam which is being cut to shape the wheel 76. The cutting edge 108 of the outer tube 102 is placed against the foam and moved circularly against the polystyrene foam sheet 12 with a gentle twisting motion with the larger tube 102 held generally perpendicular to the polystyrene foam. When the wheel 76 is cut through the polystyrene foam, the pin 112 is slowly advanced into the disk while holding the disk flush with the opening in the cutter. When the wheel 76 is pushed out of the end of the cutter, it can be pulled gently off the pin 112. With proper technique, the wheel 76 can be well cut with good roundness, edges which are crisp and square, and a hole formed in the exact center of the disk.

If desired, from time to time, the cutter can be kept sharp with a file by using upward strokes parallel with the beveled edge 108 on the outside of the large tube 102, and a little circular motion around the inside edge of the bevel 108.

A bushing can be constructed for the axle by stripping a short length of plastic off of a plastic coated paper clip, trimming one end of the stripped plastic at an angle, for example with a scissors. The plastic tube is then stuck carefully through the hole in the wheel. If polystyrene foam breaks out on the end of the plastic tubing when poked through the hole, the wheel may not function properly and should be discarded in favor of a newly constructed wheel. The ends of the bushing protruding from either side of wheel can be trimmed off with a small scissors, for example. The wheel can be mounted on a strut wire by sliding the wheel onto a strut wire, preferably made using a strut wire bending jig as described in more detail below. Holding the axle wire with the smallest tip of a needlenose pliers right up against the plastic bushing, a bend is made in the wire and excess wire trimmed using a wire cutter. The strut can then be taped to an underside of the wing in an appropriate position. If desired, a little tab of tape can be wrapped around the top of the strut wire and pressed flat to make it easier to secure the strut to the wing. It is also preferred to bend the nose wheel strut wire to rake forward to make the wing 48 sit slightly nose down to facilitate landing. Care should be exercised to fasten the wheels 76 to the wing 48 so that they are positioned to roll straight ahead upon landing. If the wing 48 experiences a turning tendency on landing, this can be corrected by repositioning the nose wheel.

A wheel strut 78 is preferably made using a bending jig supplied with the model airplane kit of the present invention. The jig comprises a base B, a plurality of pins P1, P2, P3, P4, P5 and P6 protruding from the base B along a predetermined pattern, and a lever arm L rotatably secured to the base B. The base B can be made of composite materials such as, for example, thin pieces of cardboard sandwiched alternatingly with polystyrene foam sheets of like length and width. The base materials can be taped or glued together into a solid piece. The pins P1 through P6 are preferably formed in a pattern leading inwardly from an outer edge of the base B. The pins P1–P6 are preferably formed by inserting a steel pin into the base B in the desired position, and cutting the head of the respective pin to leave a desired amount of pins P1–P6 extending upwardly from the base B. The pins P1–P6 are preferably arranged in an alternating pattern on opposite sides of the desired configuration of the wire. For example, pins P1, P2 and P3 are arranged to the right, to the left, and then to the right, respectively, of a line for receiving a first length of the wire to be bent. Pin P4 forms an apex, on the left side of the wire to allow the wire to be bent 90° around pin P4. Pins P5 and P6 are then aligned along a right angle to the direction of pins P1, P2, P3, P4, pin P5 being on the outside of the wire away from the edge of the base B, pin P6 being disposed just to side of the wire toward the edge of the base B. The wire is then bent around pin P6 to form a U-shape in the wire.

The lever arm L is secured to a shaft positioned laterally approximately half way between the pins P4 and P6, just to the side of the line defined by pins P4, P5, and P6 so that a trailing edge of the lever arm L can be positioned parallel adjacent the line defined by the pins P4, P5 and P6. The lever arm L has a width of a dimension suitable for forming a V in the wire in a plane perpendicular to the plane defined by the upper surface of the base B. The lever arm L can be made of a piece of plastic, such as plastic from a used surgical tray. The lever arm L is attached to the base B by forming a bore through the base B with a relatively large nail, and securing the lever arm L to the base B by passing a brass fastener through a hole formed toward one end of the lever arm L and the bore formed through the base B. Ends of the brass fastener are spread open and conveniently covered with tape.

In making the wire struts, the bending jig is preferably fastened to a table top, for example, using double stick tape or adhesive-backed hook-and-loop VELCRO® fasteners. Using an appropriate wire, such as, for example, 0.015-inch diameter guitar string wire, the wire strut is made by placing the wire along the pins P1–P4 and allowing the free end to extend a little beyond the edge of the base B. The wire is then bent around pin P4, making a 90° bend. The wire is then placed between pins P5 and P6 and a second 90° bend is made around pin P6, preferably holding the wire down against the base B with a thumb or finger nail and pushing the free end down toward the edge. The lever arm L is then rotated over the wire below pin P6 so that the lever arm L is generally parallel to the wire extension between pins P4 and P6. Holding the lever arm L down with a finger, the wire is lifted up and back away from the edge to form a V shape. Excess wire is cut off at the V.

In addition, the underside 56 of the wing 48 can include a launching tab (not shown) so that the plane can be launched by gripping the tab (not shown).

The airplane 10 is launched by holding it above one's head with the wing 48 level, moving the airplane 10 forward through the air and releasing with the nose 51 falling forward. Throwing too hard causes nose-up and stalls; left wingtip low creates a left-turning flight, and likewise with the right tip low. A hard downward throw with the wing-tips level can cause a loop; hard throws to the left or right can cause a boomerang flight path.

A kit for making the model airplane 10 preferably comprises one or more 10-S polystyrene trays 12, the templates 14,15 and written instructions (not shown) for putting the whole thing together. In addition, the kit can optionally include a spool of high gauge steel wire (not shown), a hot wire cutter (not shown), and the tubular wheel die. Suitable wire comprises high pitch guitar wire.

In addition, one or more associated building materials can be included although such materials are generally found in most households. Among associated building materials are paper clip nose weights 74, sandpaper, adhesive tape (not shown), and a C-cell battery (not shown).

The present model airplane and kit therefor is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

I claim:

1. A method for making a model airplane comprising the steps of:

removably securing a wing template on a plastic foam sheet molding;

cutting a wing from the foam sheet by moving a cutting tool through the foam sheet along an edge of the template;

sanding an airfoil on the wing;

attaching weights to a nose of the wing; cutting wheels from the foam sheet, attaching the wheels to a wire and securing the wire to the wing to form landing gear for the model airplane.

2. The method of claim 1, wherein the plastic foam comprises polystyrene.

3. The method of claim 2, wherein the polystyrene molding comprises a food tray.

4. The method of claim 3, wherein the polystyrene food tray has physical dimensions of a size 10-S tray.

5. The method of claim 4 wherein the wheels are cut using a die comprising a piece of thin-walled tubing of suitable diameter.

6. A method for making a model airplane comprising the steps of:

removably securing a first wing template centered on a plastic foam sheet molding;

cutting a leading edge of a wing in the sheet by moving a cutting tool through the foam sheet along the leading edge of the first template;

removably securing a second wing template centered on the plastic foam sheet molding, wherein the second wing template has a leading edge corresponding to the leading edge cut in the wing and a trailing edge;

cutting a trailing edge of a wing in the sheet by moving the cutting tool through the foam sheet along the trailing edge of the second template;

sanding an airfoil along the leading and trailing edges of the wing;

attaching weights to a nose of the wing.

7. The method of claim 6 including the step of cutting a sanding block from the portion of the foam sheet molding removed to form the leading edge.

8. The method of claim 7 including the step of cutting a template for the sanding block from a central portion of the first template along a centerline thereof.

9. The method of claim 6 wherein the first template includes a reference centerline and the method includes the step of centering the first template on the sheet by drawing a centerline on the sheet and matching the centerline drawn on the sheet with the reference centerline in the first template.

10. The method of claim 9 including the steps of cutting wheels from the foam sheet, attaching the wheels to a shaped wire, and securing an apex of the shaped wire to the wing.

11. The method of claim 10 wherein the wheel cutting step includes cutting the wheels from the foam sheet with a wheel cutter comprising a circular tubular member with a sharpened leading edge, and a plunger having an outside diameter less than an inside diameter of the tubular member, a plurality of spacing members secured on the outside diameter of the plunger for slideably receiving the plunger in the tubular member, a pin secured to extend axially from a leading end of the plunger and a stop member secured to a trailing end of the plunger to stop axial movement of the plunger in the tubular member when the pin end of the plunger is even with the sharpened leading edge of the tubular member.

12. The method of claim 10 wherein attaching the wheels to the shaped wire includes making a jig.

* * * * *